US007484861B2

(12) United States Patent
Wu

(10) Patent No.: US 7,484,861 B2
(45) Date of Patent: Feb. 3, 2009

(54) ASSEMBLY STRUCTURE FOR AN ENERGY-SAVING LAMP

(76) Inventor: Ti-Hsien Wu, No. 164-4, Allet 9, Lane 287, Sec. 3, Chung Shan Rd., Tan Tzu Hsiang, Taichung Hsien (TW)

( * ) Notice: Subject to any disclaimer, the term of this patent is extended or adjusted under 35 U.S.C. 154(b) by 128 days.

(21) Appl. No.: 11/730,753

(22) Filed: Apr. 4, 2007

(65) Prior Publication Data

US 2008/0247159 A1 Oct. 9, 2008

(51) Int. Cl.
*F21V 23/02* (2006.01)

(52) U.S. Cl. ..... 362/260; 362/294; 362/216

(58) Field of Classification Search ..... 362/294, 362/11, 260, 216, 225, 253, 235; 313/634; 315/53, 58

See application file for complete search history.

(56) References Cited

U.S. PATENT DOCUMENTS 4,300,073 A * 11/1981 Skwirut et al. ..... 315/53
4,521,837 A * 6/1985 Bouchard ..... 362/216
4,644,224 A * 2/1987 Saita et al. ..... 313/634
4,704,664 A * 11/1987 McNair ..... 362/225
5,197,798 A * 3/1993 Tickner ..... 362/235
5,523,931 A * 6/1996 Kassay et al. ..... 362/235
6,367,947 B1 * 4/2002 Itaya et al. ..... 362/216
6,390,646 B1 * 5/2002 Yan ..... 362/260
6,577,066 B1 * 6/2003 Kominami et al. ..... 315/58
6,614,166 B2 * 9/2003 Hilscher et al. ..... 313/493
7,012,373 B2 * 3/2006 Ho ..... 313/634
7,256,547 B2 * 8/2007 Kubota et al. ..... 315/56

* cited by examiner

*Primary Examiner*—Sandra L. O'Shea
*Assistant Examiner*—Gunyoung T. Lee
(74) *Attorney, Agent, or Firm*—Rosenberg, Klein & Lee

(57) ABSTRACT

An assembly structure for an energy-saving lamp includes a controlling IC board installed in the lamp seat, a lid that covers the lamp seat, lamp tubes set and fixed onto the lid, and an inductance heat radiating seat installed on the lid; the inductance heat radiating seat allows for an inductance to be installed inside. The inductance and the controlling IC board are separated, and thus damage to the inductance and related components from continuous overheating of the controlling IC board can be avoided. Due to the isolated design of the lid and the lamp seat it is easy to disassemble and change the component parts of either the lamp tubes or the controlling IC board in the event of malfunction. Finally, because the lamp tubes of the present invention branch out horizontally, the lamp's area of illumination is significantly increased. Overall, the present invention achieves the advantages of reducing cost, convenient repair and increasing the lighting area.

3 Claims, 6 Drawing Sheets

ASSEMBLY STRUCTURE FOR AN ENERGY-SAVING LAMP

BACKGROUND OF THE INVENTION

1. Field of the Invention

The present invention relates to an energy-saving lamp. More particularly, the present invention relates to the assembly structure for an energy-saving lamp.

2. Description of Related Art

A conventional energy-saving lamp, as shown in FIG. 6, comprises lamp tubes 50 and an assembly seat 5, wherein the assembly seat 51 contains an inner electronic ballast 510 (not shown), and the lamp tubes 50 are assembled with the assembly seat 51 by sol glue. Although the aforesaid energy-saving lamp accomplishes the function of saving power, it still has some improvable defects, such as:

1. High cost: If one or part of the lamp tube of the energy-saving lamp malfunctions, it is not possible to change a single lamp tube or the electronic ballast alone. On the contrary, the user must replace the entire lamp at a high cost to the consumer.

2. Unable to repair malfunction: If one or part of the lamp tube of the energy-saving lamp has malfunctioned, it is not possible to change a single lamp tube or the electronic ballast alone. Malfunction is irreparable and the user must replace the entire lamp.

3. Narrow area of illumination: The lamp tubes are installed vertically and in a downward direction, therefore the illuminating square is concentrated and narrow.

The present invention is intended to improve upon the above mentioned drawbacks, including the cost efficiency, the inability to repair malfunction, and the narrow area of illumination.

SUMMARY OF THE INVENTION

The primary object of the present invention is an energy-saving lamp, more particularly a lamp with an assembly structure, which comprises: a lamp seat, a controlling IC board, a lid, and lamp tubes, wherein the lamp seat comprises elastic buckles, screwing seats and heat radiating holes; the controlling IC board comprises a first electricity conducting copper seat, a second electricity conducting copper seat and screwing holes; and the lid comprises embedded apertures, buckling grooves, an inductance heat radiating seat and heat radiating holes. The controlling IC board is installed at the inner side of the lamp seat and has screwing holes that correspond with the screwing seats of the lamp seat allowing the fasteners to fix the controlling IC board and the lamp seat together. In addition, the lid covers the top of the lamp seat so that the elastic buckles of the lamp seat can be buckled with the buckling grooves of the lid. The lamp tubes are set onto the embedded apertures of the lid and fixed on such apertures. The inductance heat radiating seat is installed above the lid which allows for an inductance to be installed inside. Separation of the inductance and the controlling IC board prevents damage to the inductance and related components caused by the high temperature of the controlling IC board. Furthermore, due to the isolated design of the lid and the lamp it is easy to disassemble and change the parts either of the lamp tubes or the controlling IC board in the case of malfunction. Finally, because the lamp tubes of the present invention branch out horizontally, the area of illumination of the lamp is effectively increased as compared to a conventional lamp.

Overall, the present invention contains the advantages of reducing cost, making repair convenient, and enhancing the lighting area.

Other objects, advantages and novel features of the invention will become more apparent in the following detailed description taken in conjunction with the accompanying diagrams.

DETAILED DESCRIPTION OF PREFERRED EMBODIMENT

Figure 1:
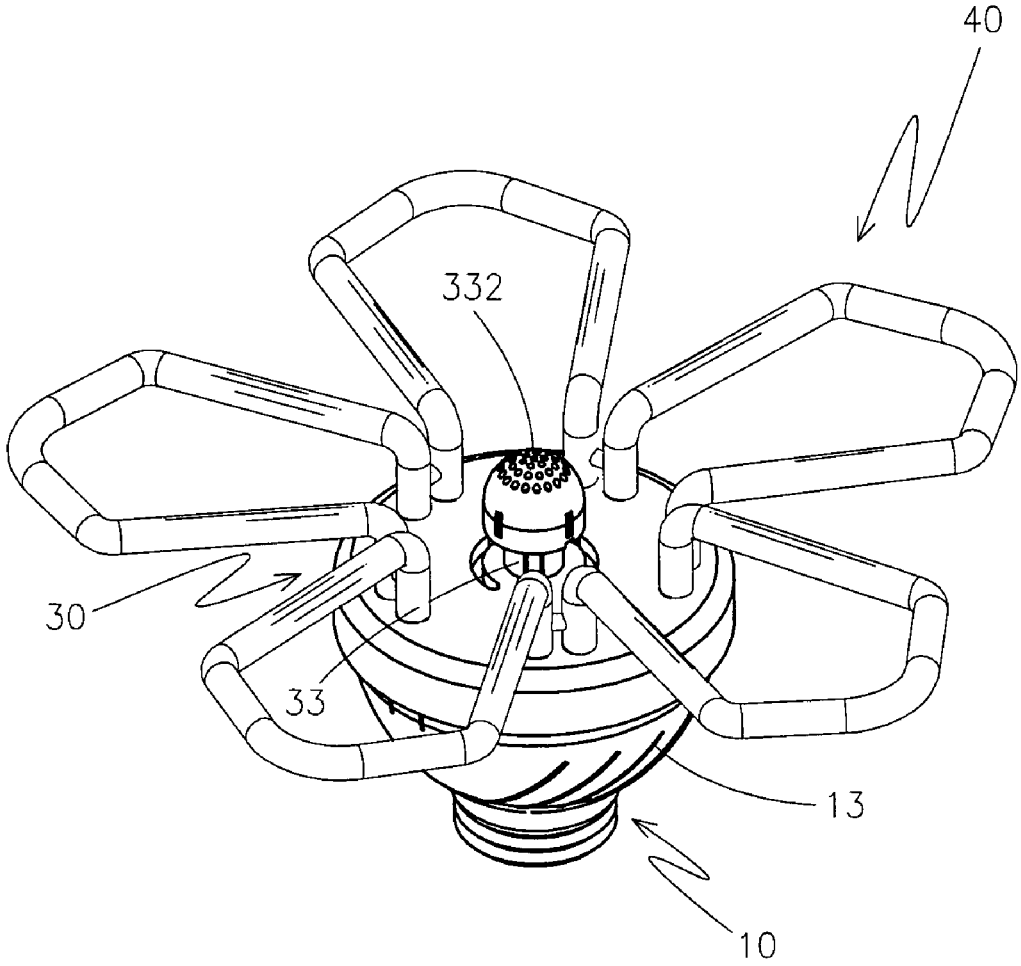
FIG. 1 is a perspective view schematically showing the energy-saving lamp of the present invention.

While this invention is capable of embodiment in many different forms, shown in the drawings and herein described in detail is the preferred embodiment of the invention. The preferred embodiment is disclosed with the understanding that the present description is but one example of the principles of the invention and is not intended to limit the broad aspects of the invention to the single embodiment illustrated.

Figure 2:
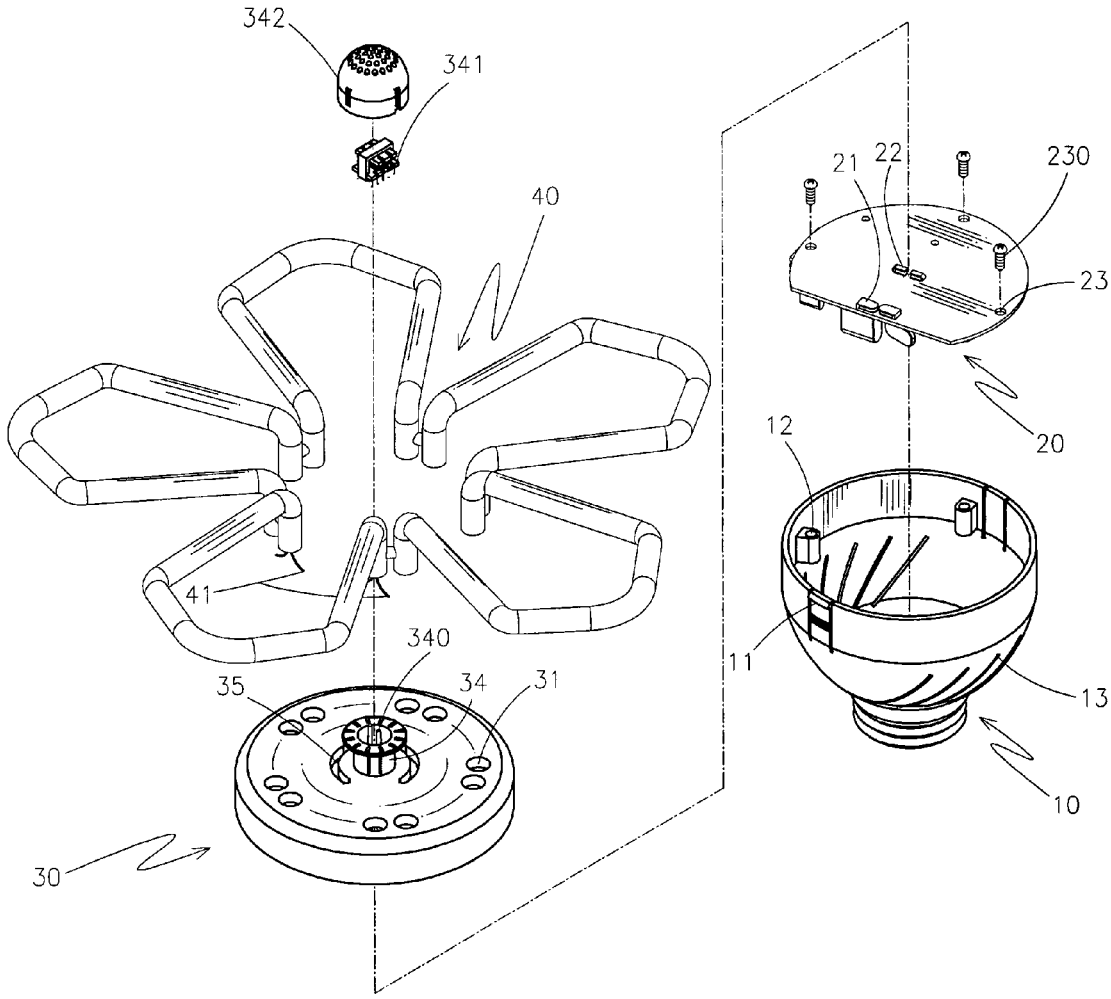
FIG. 2 is a segmented view schematically showing the energy-saving lamp of the present invention.
Figure 3:
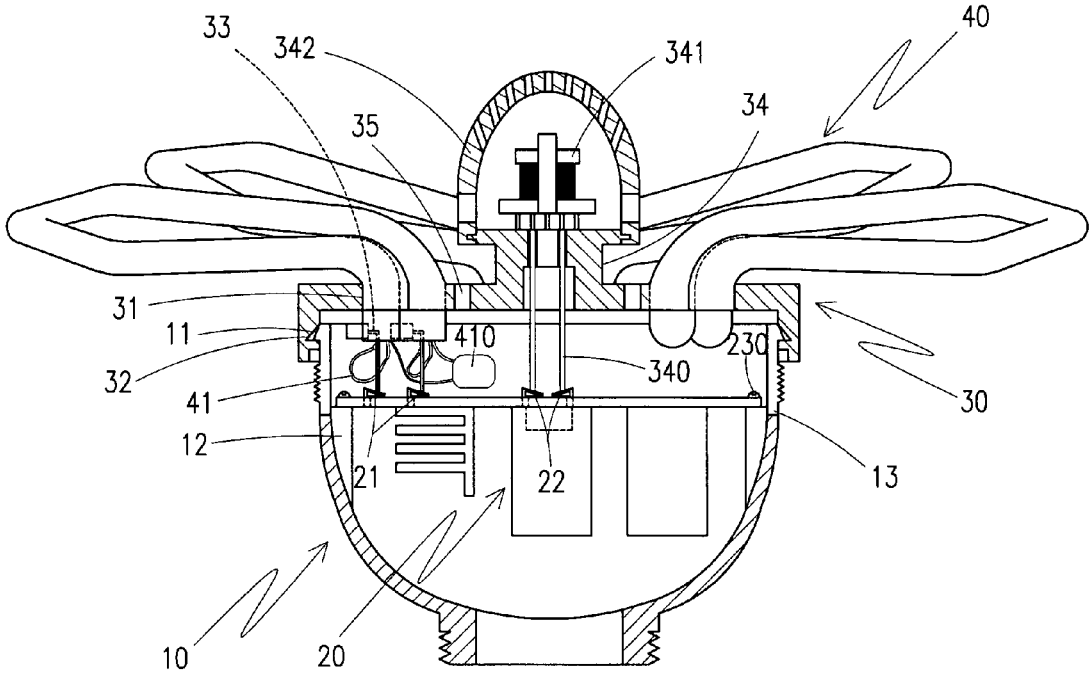
FIG. 3 is a cross-sectional view schematically showing the energy-saving lamp of the present invention.

FIGS. 1 to 3 are perspective, segmented perspective and sectional views schematically showing an energy-saving lamp of the present invention.

The lamp comprises:

a lamp seat 10 having elastic buckles 11 which are installed on the two side walls of the lamp seat 10, multiple screwing seats are installed on the inner wall of the lamp seat 10, and multiple heat radiating holes 13 are defined on the wall of the lamp seat 10;

a controlling IC board 20 having a first electricity conducting copper seat 21 and a second electricity conducting copper seat 22, both of which are installed on the IC board 20; in addition, multiple screwing holes are peripherally defined near the edge of the IC board 20. The controlling IC board 20 is configured inside the lamp seat 10, it comprises multiple screwing holes 23 that correspond to the screwing seats 12 of the lamp seat 10, making it possible for the fasteners 230 to fix the IC board 20 and the lamp seat 10 together;

a lid 30 having multiple embedded apertures 31 defined above the lid 30, buckling grooves 32 defined on the inner wall of the lid 30, a first conductive stick 33 configured on the inner side of the lid 30, and an inductance heat radiating seat 34 installed on the central top of the lid 30. Furthermore, a conductive stick 340 is installed in the inductance heat radiating seat 34 and it is connected to an inductance 341. A heat radiating cover 342 is covered on the inductance heat radiating seat 34, meanwhile, multiple heat radiating holes 35 are defined on the surface of the lid 30. The lid 30 is used to cover the top of the lamp seat 10 such that the elastic buckles 11 of the lamp seat 10 can be buckled with the buckling grooves 32 of the lid 30. Moreover, the first conductive stick 33 of the lid 30 is pressed down and conducted with the first electricity conducting copper seat 21 of the controlling IC board 20, and the conductive stick 340 of the inductance heat radiating seat 34 is pressed down and conducts with the second electricity conducting copper seat 22 of the controlling IC board 20; and lamp tubes 40 having two conducting wires 41 and where the lamp tubes 40 are set onto the embedded apertures 31 of the lid 30. The two conducting wires 41 of the lamp tubes 40 have one end connected with a capacitance 410 and the other connected and conducted with the first conductive stick 33.

In light of the structures described above, the present invention has accomplished an assembly structure for an energy-saving lamp.

Figure 4:
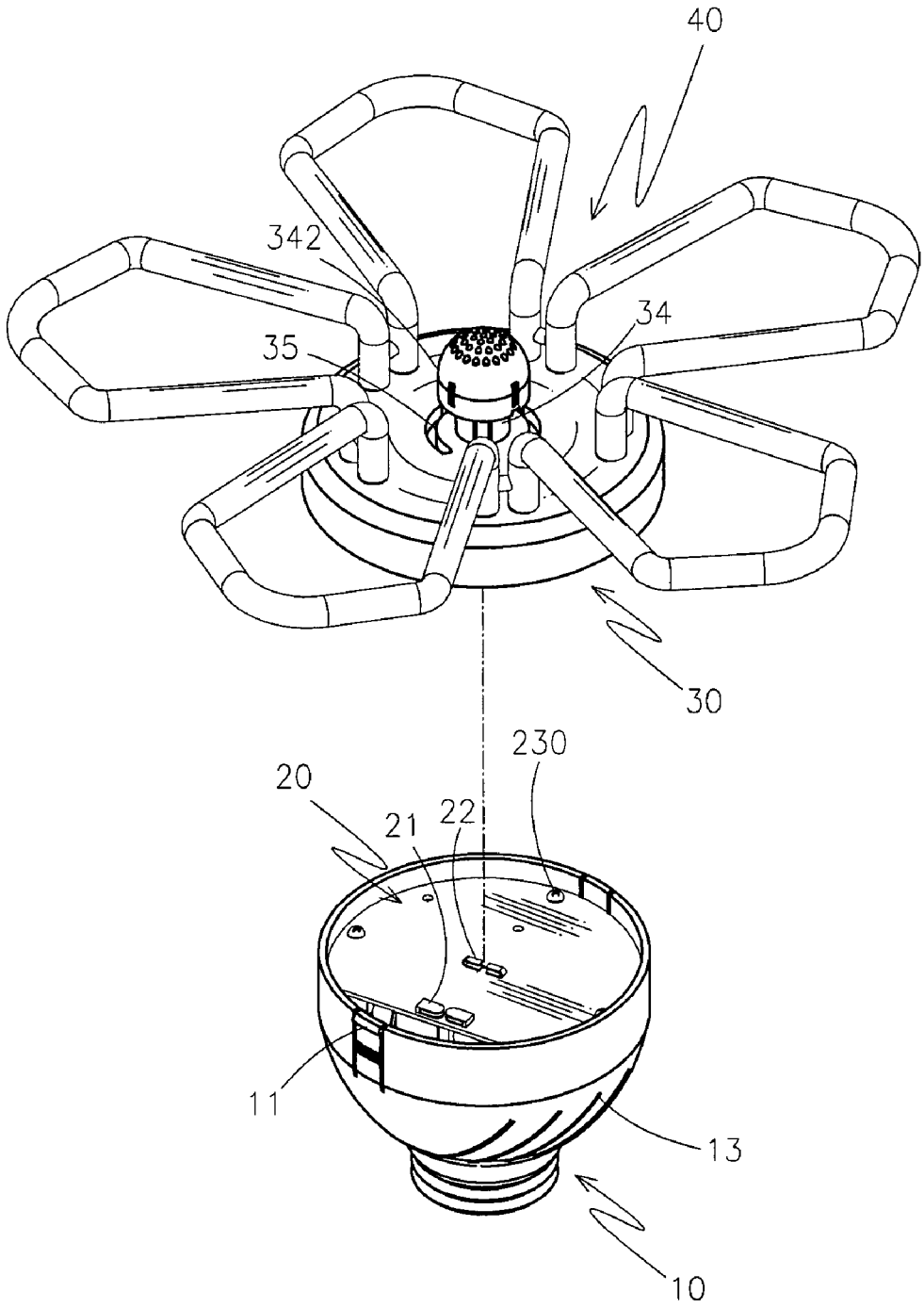
FIG. 4 is a perspective view schematically showing the practical use of the present invention.

FIG. 4 is a perspective view schematically showing the practical use of the present invention. When the lamp is assembled, the lid 30, having been installed with the lamp tubes 40, covers the top of the lamp seat 10, and the elastic buckles 11 of the lamp seat 10 are buckled into the buckling grooves 32 of the lid 30, thus completing the assembly of the lamp seat 10 and the lid 30. The first conductive stick 33 of the lid 30 is pressed down and conducted with a first electricity conducting copper seat 21 of the controlling IC board 20. At the same time, the conductive stick 340 of the inductance heat radiating seat 34 is also pressed down and conducts with a second electricity conducting copper seat 22 of the controlling IC board 20 such that electricity is conducted throughout the lamp. The inductance 341 and the controlling IC board 20 are separated, and thus damage to the inductance 341 and related components from continuous overheating of the controlling IC board 20 can be avoided. Due to the isolated design of the lid 30 and the lamp seat 10 it is easy to disassemble and change the component parts of either the lamp tubes 40 or the controlling IC board 20 in the event of malfunction. Finally, because the lamp tubes 40 of the present invention branch out horizontally, the lamp's area of illumination is significantly increased. Overall, the present invention achieves the advantages of reducing cost, convenient repair and increasing the lighting area.

Figure 5:
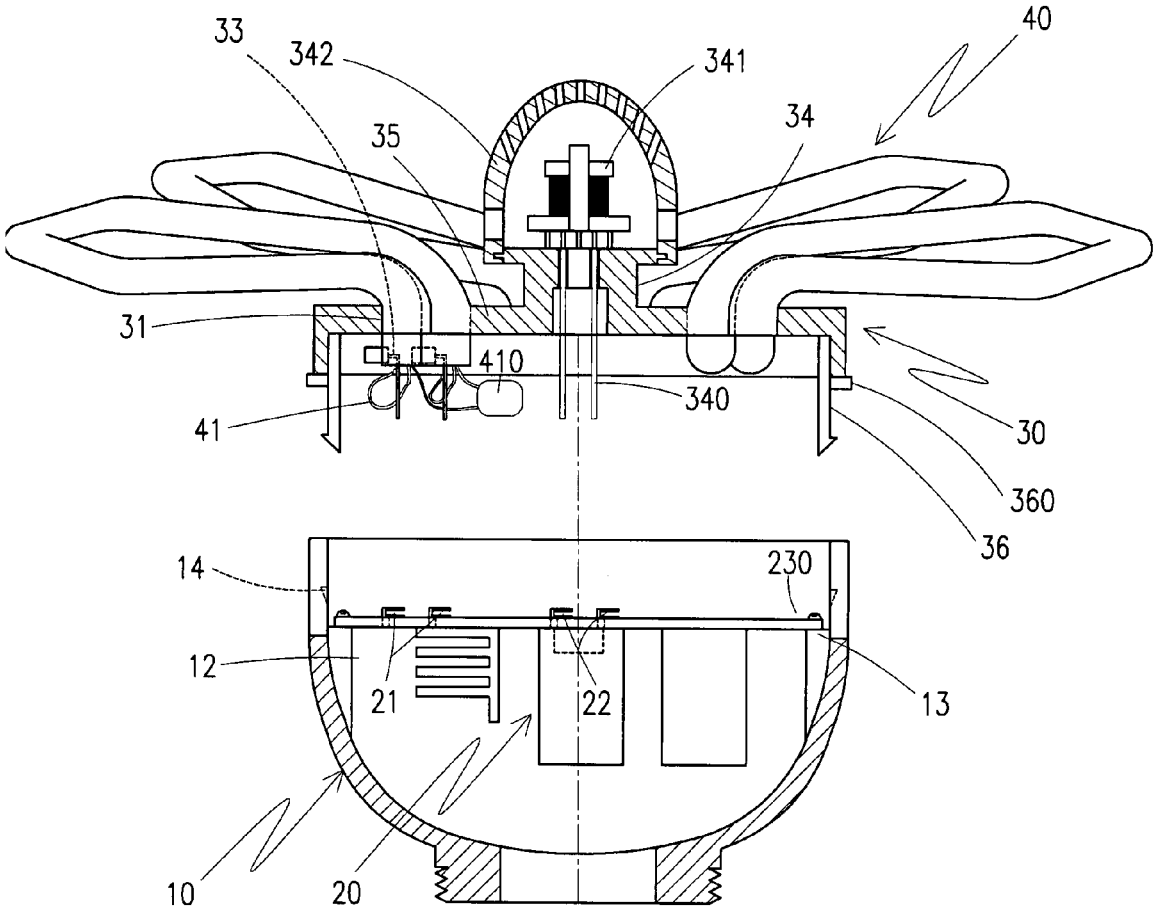
FIG. 5 is a cross-sectional view schematically showing another aspect of the present invention.
Figure 6:
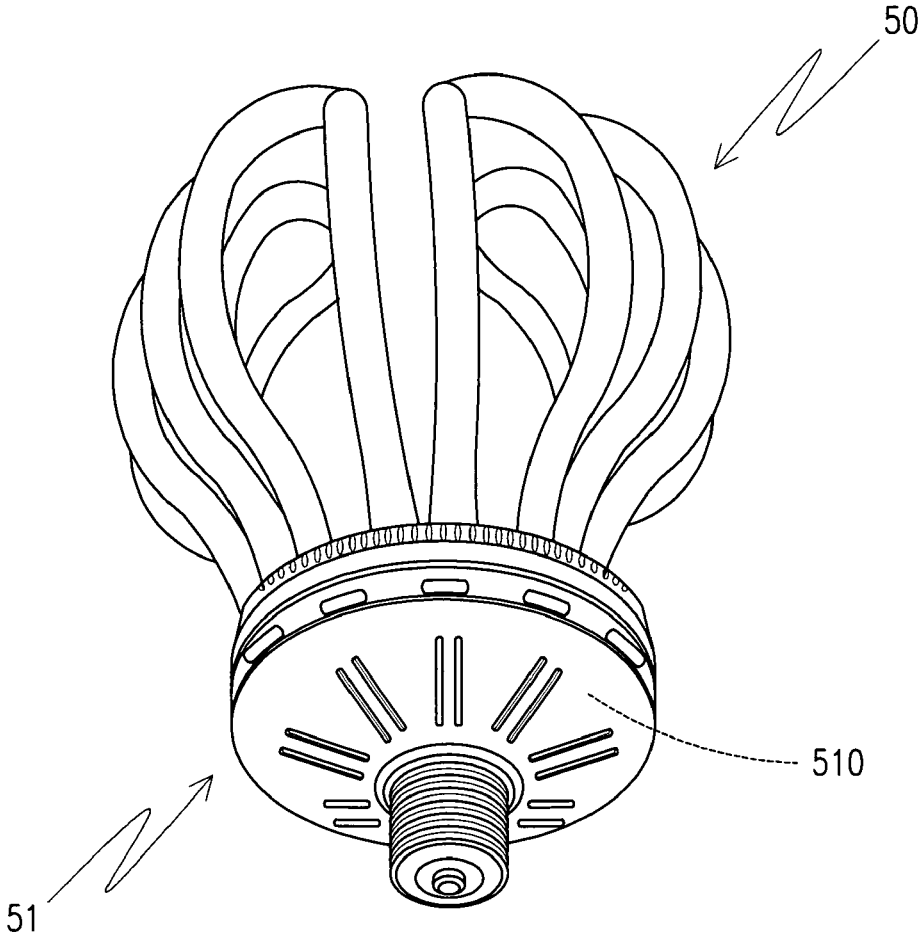
PRIOR ART FIG.6
FIG. 6 is a cross-sectional view of the conventional energy-saving lamp.

FIG. 5 is a cross-sectional view schematically showing another aspect of the present invention, wherein the structure of this other aspect is similar to the structure shown in FIGS. 1 to 4, the only difference being the aforesaid elastic buckles 11 of the lamp seat 10 have been changed and installed on the lid 30, which have its reference number 36, and a pressable button 360 is defined on said elastic buckles 36. The buckling grooves 32 originally installed on the lid 30 have been moved and are now installed on the inner wall of the lamp seat 10 to form buckling grooves 14. The structure stated above provides another utility aspect of the present invention.

Although numerous characteristics and advantages of the present invention have been set forth in the foregoing description, together with details of the structure and function of the invention, this disclosure is one example only, and changes may be made with regard to specific details, particularly in matters of shape, size, and arrangement of parts within the invention to the full extent indicated by the general meaning of the terms in which the appended claims are expressed.

What is claimed is:

1. An assembly structure for an energy-saving lamp, comprising:

a lamp seat having elastic buckles which are installed on the two side walls of the lamp seat and multiple screwing seats which are installed on the inner wall of the lamp seat;

a controlling integrated circuit (IC) board having a first electricity conducting copper seat and a second electricity conducting copper seat, both of which are installed on the IC board; in addition, multiple screwing holes are peripherally defined near the edge of the IC board; the controlling IC board is configured inside the lamp seat, the controlling IC board comprises multiple screwing holes that correspond to the screwing seats of the lamp seat, and the fasteners are passed through the screw holes and fix the IC board and the lamp seat together;

a lid having multiple embedded apertures defined above the lid, buckling grooves defined on the inner wall of the lid, a first conductive stick configured on the inner side of the lid, and an inductance heat radiating seat installed on the central top of the lid; furthermore, a conductive stick is installed in the inductance heat radiating seat and the conductive stick is connected to an inductance; a heat radiating cover is covered on the inductance heat radiating seat, meanwhile, multiple heat radiating holes are defined on the surface of the lid; the lid is used to cover the top of the lamp seat such that the elastic buckles of the lamp seat are buckled with the buckling grooves of the lid; moreover, the first conductive stick of the lid is pressed down and conducted with the first electricity conducting copper seat of the controlling IC board, and the conductive stick of the inductance heat radiating seat is pressed down and conducts with the second electricity conducting copper seat of the controlling IC board; and lamp tubes having two conducting wires and where the lamp tubes are set onto the embedded apertures of the lid; the two conducting wires of the lamp tubes have one end connected with a capacitance and the other connected and conducted with the first conductive stick.

2. An assembly structure as claimed in claim 1, wherein the lamp seat further comprises multiple heat radiating holes on the surface of the wall.

3. An assembly structure as claimed in claim 1, wherein the lid further comprises heat radiating holes on the surface of the lid.

* * * * *